US011371271B2

(12) United States Patent
Manikkath et al.

(10) Patent No.: US 11,371,271 B2
(45) Date of Patent: Jun. 28, 2022

(54) FLUSH INTERIOR VEHICLE DOOR CONTROL ARRANGEMENT

(71) Applicant: Jaguar Land Rover Limited, Coventry (GB)

(72) Inventors: Arun Manikkath, Coventry (GB); Rajesh Padmarajan, Coventry (GB)

(73) Assignee: Jaguar Land Rover Limited, Coventry (GB)

( * ) Notice: Subject to any disclaimer, the term of this patent is extended or adjusted under 35 U.S.C. 154(b) by 737 days.

(21) Appl. No.: 16/077,718

(22) PCT Filed: Mar. 7, 2017

(86) PCT No.: PCT/EP2017/055238
§ 371 (c)(1),
(2) Date: Aug. 13, 2018

(87) PCT Pub. No.: WO2017/167554
PCT Pub. Date: Oct. 5, 2017

(65) Prior Publication Data

US 2019/0055760 A1 Feb. 21, 2019

(30) Foreign Application Priority Data

Mar. 29, 2016 (IN) ..... 201611010884

(51) Int. Cl.
*E05B 85/10* (2014.01)
*E05B 81/28* (2014.01)
(Continued)

(52) U.S. Cl.
CPC ..... *E05B 85/107* (2013.01); *E05B 79/20* (2013.01); *E05B 81/28* (2013.01); *E05B 81/76* (2013.01);
(Continued)

(58) Field of Classification Search
CPC ..... E05B 85/107; E05B 85/103; E05B 79/20; E05B 77/24; E05B 81/28; E05B 81/76;
(Continued)

(56) References Cited

U.S. PATENT DOCUMENTS 6,698,262 B2 * 3/2004 Wittwer ..... E05B 85/107 70/208
10,550,611 B2 * 2/2020 Och ..... E05B 85/107
(Continued)

FOREIGN PATENT DOCUMENTS

DE 197 27 536 A1 1/1999
DE 10340792 A1 * 4/2005 ..... E05B 85/107
(Continued)

OTHER PUBLICATIONS

"Slide," Merriam-Webster.com Dictionary, Merriam-Webster (accessed Feb. 3, 2021) (Year: 2021).*
(Continued)

*Primary Examiner* — Kristina R Fulton
*Assistant Examiner* — Emily G. Brown
(74) *Attorney, Agent, or Firm* — Reising Ethington P.C.

(57) ABSTRACT

A vehicle door control arrangement 10 for permitting opening of a vehicle door 12, the arrangement 10 including a door handle means 14. A control mechanism 16 is locatable in the door 12, and operable by movement of the door handle means 14 to cause door latching means to disengage from the closed position. A door handle movement means 18 is provided, operable to selectively move the door handle means 14 between a rest position in which the door handle means 14 is located substantially within the door 12, and an operable position in which the door handle means 14 extends outwardly from the door 12 such that the door handle means 14 can be manually engaged by a person. Operating means 20 is provided to detect when it is required
(Continued)

to open the door, and in response to cause the door handle movement means 18 to move the door handle means 14 from the rest position to the operable position.

20 Claims, 10 Drawing Sheets

(51) Int. Cl.
*E05B 79/20* (2014.01)
*E05B 81/76* (2014.01)
*E05B 85/12* (2014.01)

(52) U.S. Cl.
CPC ..... *E05B 85/12* (2013.01); *E05Y 2900/531* (2013.01)

(58) Field of Classification Search
CPC ..... E05B 81/64; E05B 81/77; E05B 81/78; E05B 5/00; E05B 5/003; E05B 5/006; E05B 85/08; E05B 85/10; E05B 85/12; E05Y 2900/531; Y10T 292/57; Y10S 292/31; B60R 25/24; G07C 2209/65; G07C 9/00309
See application file for complete search history.

(56) References Cited

U.S. PATENT DOCUMENTS

2009/0039671 A1* 2/2009 Thomas ..... E05B 81/76 296/146.1
2013/0076048 A1 3/2013 Aerts et al.
2014/0265372 A1* 9/2014 Smart ..... E05B 5/003 292/336.3
2014/0327252 A1 11/2014 Sobecki et al.
2015/0039180 A9* 2/2015 Aerts ..... E05B 85/103 701/36
2015/0233154 A1* 8/2015 Smart ..... E05B 81/90 70/237
2015/0368935 A1 12/2015 Sugita et al.

FOREIGN PATENT DOCUMENTS

DE 10 2015 105 644 A1 11/2015
EP 1 072 466 A2 1/2001
WO WO 2015/074020 A1 5/2015

OTHER PUBLICATIONS

"Slidable," Merriam-Webster.com Dictionary, Merriam-Webster (accessed Feb. 3, 2021) (Year: 2021).*
Patents Act 1977: Combined Search and Examination Report under Sections 17 and 18(3), UKIPO Application No. GB1609391.6, dated Oct. 31, 2016, 5 pp.
International Search Report and Written Opinion of the International Searching Authority, International Application No. PCT/EP2017/055238, dated Jun. 16, 2017, 13 pp.

* cited by examiner

FLUSH INTERIOR VEHICLE DOOR CONTROL ARRANGEMENT

RELATED APPLICATIONS

This application is a 35 U.S.C. § 371 national stage application of PCT Application No. PCT/EP2017/055238, filed on Mar. 7, 2017, which claims priority from Indian Patent Application No. 201611010884 filed on Mar. 29, 2016, the contents of which are incorporated herein by reference in their entireties. The above-referenced PCT International Application was published in the English language as International Publication No. WO 2017/167554 A1 on Oct. 5, 2017.

TECHNICAL FIELD

The present disclosure relates to a vehicle door control arrangement. In particular, but not exclusively, it relates to an interior vehicle door arrangement for use in cars.

Aspects of the invention relate to a vehicle door control arrangement, a vehicle door including such a vehicle door control arrangement, a vehicle including one or more doors including such an arrangement, and also a method of controlling opening of a vehicle door.

BACKGROUND

Conventionally interior door handles on vehicles and especially cars, include a pivoted handle accessible at all times on the interior side of the door, usually with a recess behind the handle to enable a person to access the handle. In most instances the handle is pulled inwardly and/or upwardly to open the door. This handle and the recess therefore prevent a smooth profile being provided on the door interior.

It is an aim of the present invention to address disadvantages associated with the prior art.

SUMMARY OF THE INVENTION

Aspects of the embodiments of the invention provide a vehicle door control arrangement, a vehicle door including such an arrangement, a vehicle including one or more doors including such an arrangement, as claimed in the appended claims, and also a method of controlling opening of a vehicle door.

According to an aspect of the invention there is provided a vehicle door control arrangement for permitting opening of a vehicle door, the arrangement including a door handle means, a control mechanism locatable in the door and operable by movement of the door handle means to cause door latching means to disengage from a closed condition, door handle movement means operable to selectively move the door handle means between a rest position in which the door handle means is locatable substantially within the door, and an operable position in which the door handle means extends outwardly from the door such that the door handle means can be manually engaged by a person, and operating means to detect when it is required to open the door, and in response to cause the door handle movement means to move the door handle means from the rest position to the operable position.

This means that a door handle is substantially flush to the surface of the vehicle during normal use of the vehicle, but extends into the vehicle when it is required to open the door.

This enables a smooth profile to be maintained on the interior of the door, except when it is actually required to open the door.

The operating means may be configured to detect movement of a person in the vicinity of the vehicle door control arrangement.

This means that a person can cause the door handle to move to an operable position using a gesture or similar.

The operating means may include an infrared sensor.

This allows actuation of the arrangement without requiring the door to be touched.

In an alternative configuration the operating means may be operable by touch at a particular location, and the arrangement may include a touch sensitive member locatable on an inside surface of the door.

This will enable the handle means to be caused to move to an inoperable position, without the requirement of any detectable gesture.

The vehicle door control arrangement may include a control unit operably connected to the door handle movement means and the operating means.

This provides for control of the arrangement in response to signals from the various components.

The control unit may be configured such that after the handle means has been in the operable position for a required time, the door handle movement means will automatically move the handle means back to the rest position.

This means that the handle means will only be extending into the vehicle when required for opening the door.

The control unit may be configured to only permit operation of the door handle movement means to move the door handle means to the operable position, when it is detected that the vehicle is not moving.

This prevents a person opening the door other than when the vehicle is stopped.

The arrangement may be configured to detect if the handle means is obstructed when moving to the operable position, and if an obstruction is detected the handle means will automatically remain in, or return to, the rest position.

This prevents the arrangement and/or door handle means from being damaged if movement to the operable position is obstructed.

The arrangement may be configured to detect if the handle means is obstructed when returning to the rest position, and if an obstruction is detected the handle means returns to the operable position for a required time period.

This prevents a person's hand being trapped as the handle means is returning to the rest position.

The arrangement may be configured to detect if a load is being applied to the handle means by a person, and if so to not move the handle means to the rest position when a load is detected thereon, for instance by a person turning or lifting the handle means.

This prevents the handle means being moved to a rest position whilst the handle means is being moved to open a door.

The control unit may be configured such that a signal is emitted in one or more of a number of instances, including: if the handle means moves to the operable position; or if it is detected that the handle means cannot, or should not, be moved to either the operable or rest positions. The signal may be audible and/or may be visual, and the arrangement may include a light.

This provides a visual and/or audible indication that the handle means has moved to an operable position or cannot or should not be moved to either the operable or rest positions.

The handle means may be configured such that it can be operated even if not in the operable position.

This means that in the event of a power failure, or a failure of the control arrangement, a door can still be opened.

The handle means may be slidably moveable between the rest and operable positions.

This enables the handle means to smoothly slide between the rest and operable positions, providing an impressive feature to a person in the vehicle.

A linear actuator may be provided for slidably moving the handle means between the rest and operable positions.

The control mechanism may include a link connecting the handle means to door latching means. The link may be cranked, and may have a substantially V-shaped profile. A cable may extend from the link to the door latching means. The link may be pivotally mounted at the bend in the crank.

A slidable connection may be provided between the handle means and the link, and the connection may move relative to the link as the handle means moves between the rest and operable positions.

A connection may be provided between the handle means and the linear actuator which enables a person to turn the handle means relative to the linear actuator.

A pivotal mounting may be provided for the handle means on the connection to the linear actuator, to permit the handle means to be pivotally moved if manual operation of the arrangement is required.

According to another aspect of the invention there is provided a vehicle door including a vehicle door control arrangement as defined above.

The vehicle door may include a door latching means.

The door handle means may be an interior door handle.

According to a further aspect of the invention there is provided a vehicle including one or more doors including a vehicle door control arrangement as defined above.

According to a still further aspect of the invention there is provided a vehicle door control arrangement for permitting opening of the vehicle door, the arrangement including a door handle means which is selectively moveable between a rest position located substantially within the door, and an operable position extending outwardly from the door so as to be manually engageable by a person.

According to a yet further aspect of the invention there is provided a vehicle door control arrangement for permitting opening of a vehicle door, the arrangement including a door handle, a control mechanism locatable in the door and operable by movement of the door handle to cause a door latch to disengage from a closed condition, a door handle movement mechanism operable to selectively move the door handle between a rest position in which the door handle is located substantially within the door, and an operable position in which the door handle extends outwardly from the door such that the door handle can be engaged by a person, and a detector to detect when it is required to move the door handle from the rest position to the operable position and in response to cause the door handle movement mechanism to move the door handle to the operable position.

According to an additional aspect of the invention there is provided a method of controlling opening of a vehicle door, the method comprising locating a door handle means in a rest position substantially within the door, detecting movement of a person within the vehicle adjacent the door, in dependence on detection of such a movement moving the door handle means to an operable position extending outwardly from the door such that the door handle means can be manually engaged by a person.

This means that a door handle is concealed during normal use of the vehicle, but extends into the vehicle when it is required to open the door. This enables a smooth profile to be maintained on the interior of the door, except when it is actually required to open the door.

Upon detection of such a movement a check may be made as to whether the vehicle is moving, and the door handle means only permitted to move to the operable position if the vehicle is not moving.

This prevents a person opening the door other than when the vehicle is stopped.

A check may be made as to whether the door handle means is obstructed from moving to the operable position, and if an obstruction is detected the door handle means will automatically remain in, or return to, the rest position, and an audible and/or visual signal may be given.

This prevents the arrangement and/or door handle means from being damaged if movement to the operable position is obstructed.

The door handle means may automatically return to the rest position after a set length of time in the operable position.

This means that the handle means will only be extending into the vehicle when required for opening the door.

A check may be made as to whether the door handle means is obstructed from moving to the rest position, and if an obstruction is detected the door handle means will automatically remain in, or return to, the operable position.

This prevents a person's hand or fingers being trapped as the handle means is returning to the rest position.

Before moving back to the rest position a check may be made as to whether the door handle means has been actuated by a user, and if so the door handle means will remain in the operable position for a further set length of time.

This prevents the handle means being moved to a rest position whilst the handle means is being moved to open a door.

Before moving back to the rest position a check may be made as to whether such a movement is again detected, and if so the door handle means will remain in the operable position for a further set length of time.

Any of the set lengths of time may be selectively adjusted if required.

According to a further aspect of the invention there is provided a computer program which, when run on a processor, causes one or more of the methods described herein to be performed According to a further aspect of the invention there is provided a non-transitory computer readable medium storing a computer program comprising computer program instructions, that, when performed by one or more processors, causes one or more of the methods described herein to be performed.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

One or more embodiments of the invention will now be described, by way of example only, with reference to the accompanying drawings, in which.

DETAILED DESCRIPTION

Figure 3:
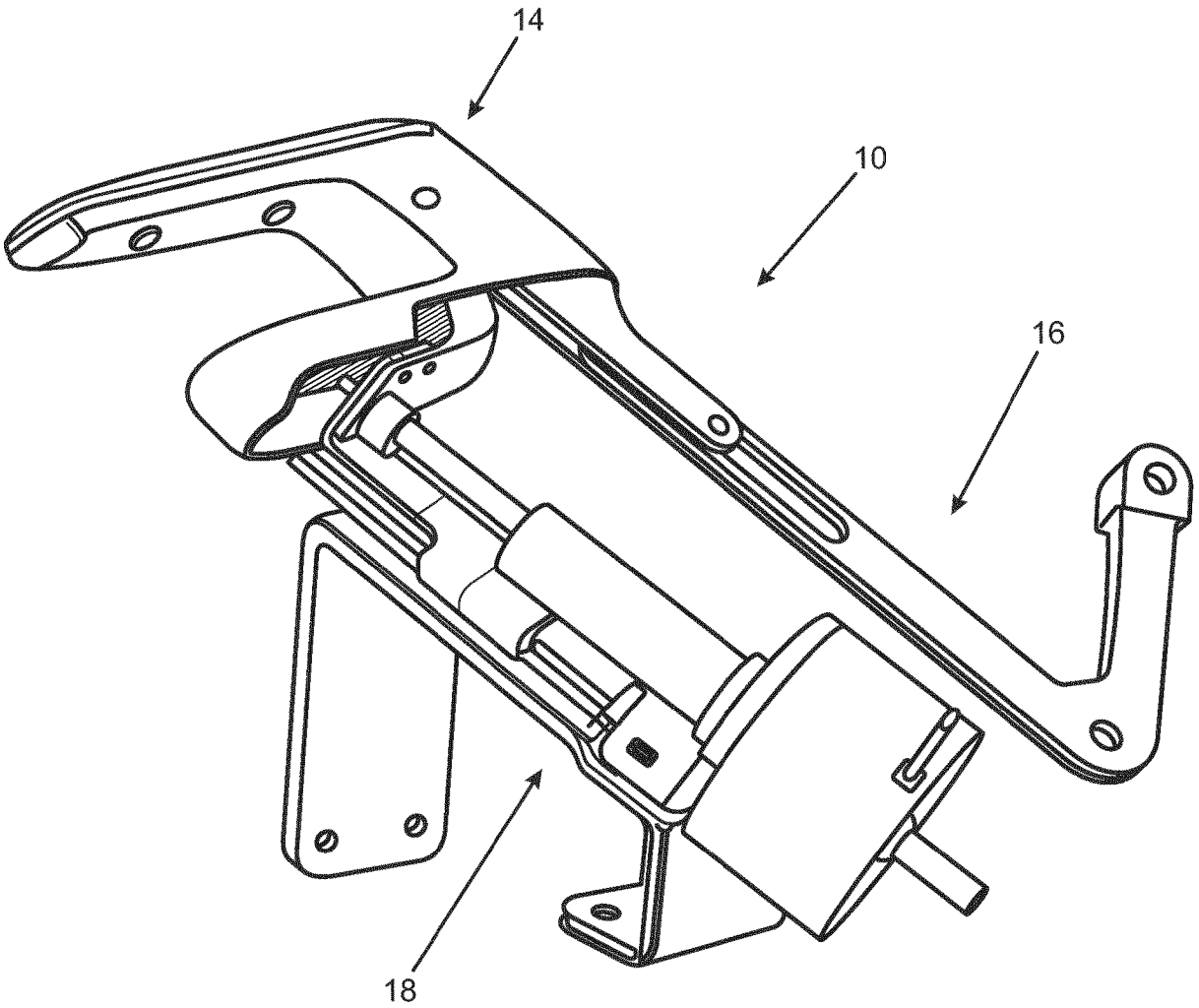
FIG. 3 is a diagrammatic perspective view of part of the arrangement of FIG. 1 in a rest position.

The Figures illustrate a first vehicle door control arrangement 10 for permitting opening of a vehicle door 12, the arrangement 10 including a door handle means 14, connectable to a door latching means (not shown), a control mechanism 16 locatable in the door 12 operable by movement of the door handle means 14 to cause the door latching means to disengage from a closed position, door handle movement means 18 operable to selectively move the door handle means 14 between a rest position (FIGS. 3, 6 and 7) in which the door handle means is located substantially within the door 12, and an operable position (FIGS. 4, 5, 8 and 9) in which the door handle means 14 extends outwardly from the door 12, such that the door handle means 14 can be manually engaged by a person, and operating means 20 to detect when it is required to open the door, and in response to cause the door handle movement means 18 to move the door handle means 14 from the rest position to the operable position.

Figure 1:
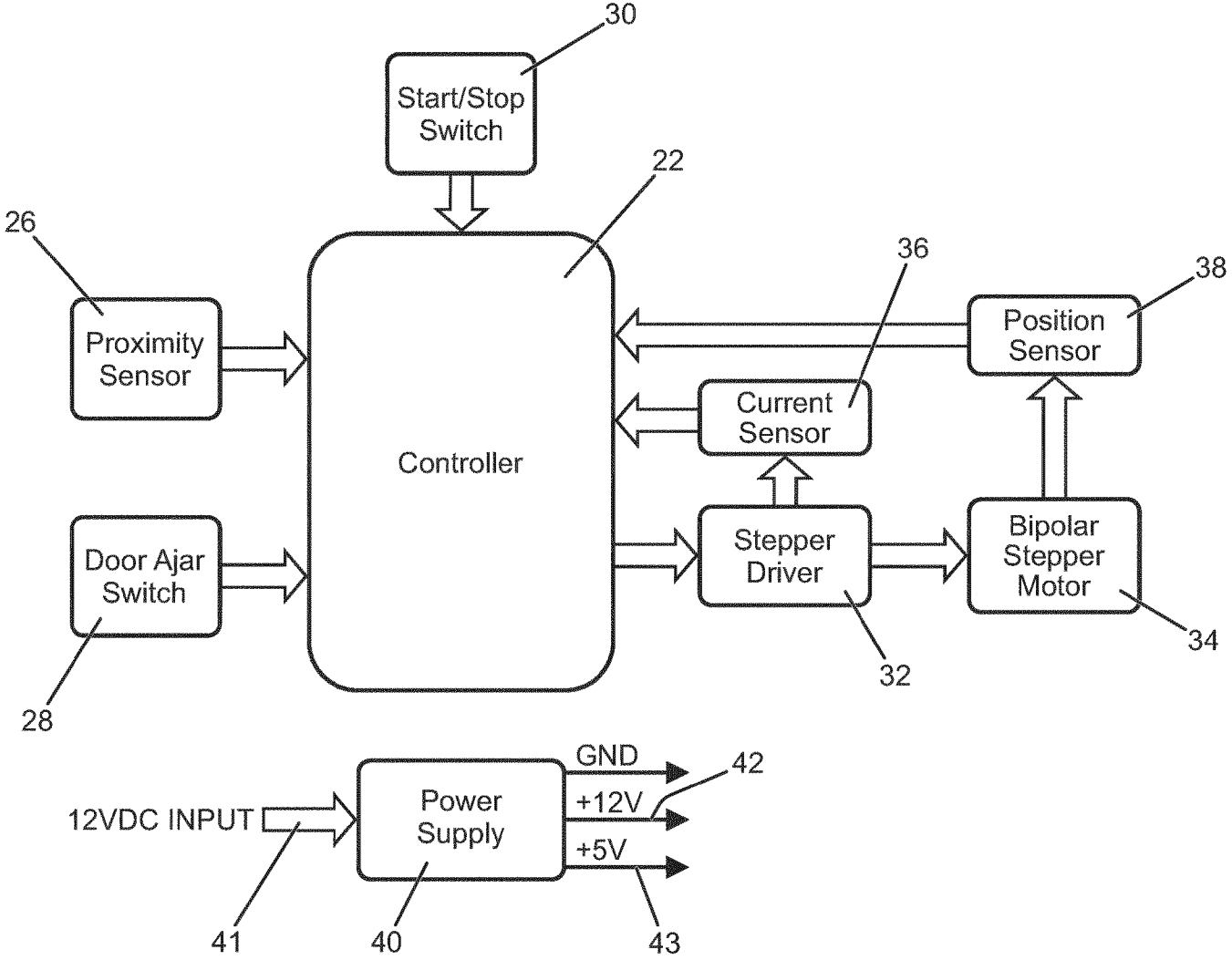
FIG. 1 is a diagrammatic block diagram of the main components of a vehicle door control arrangement according to an embodiment of the invention.
Figure 11:
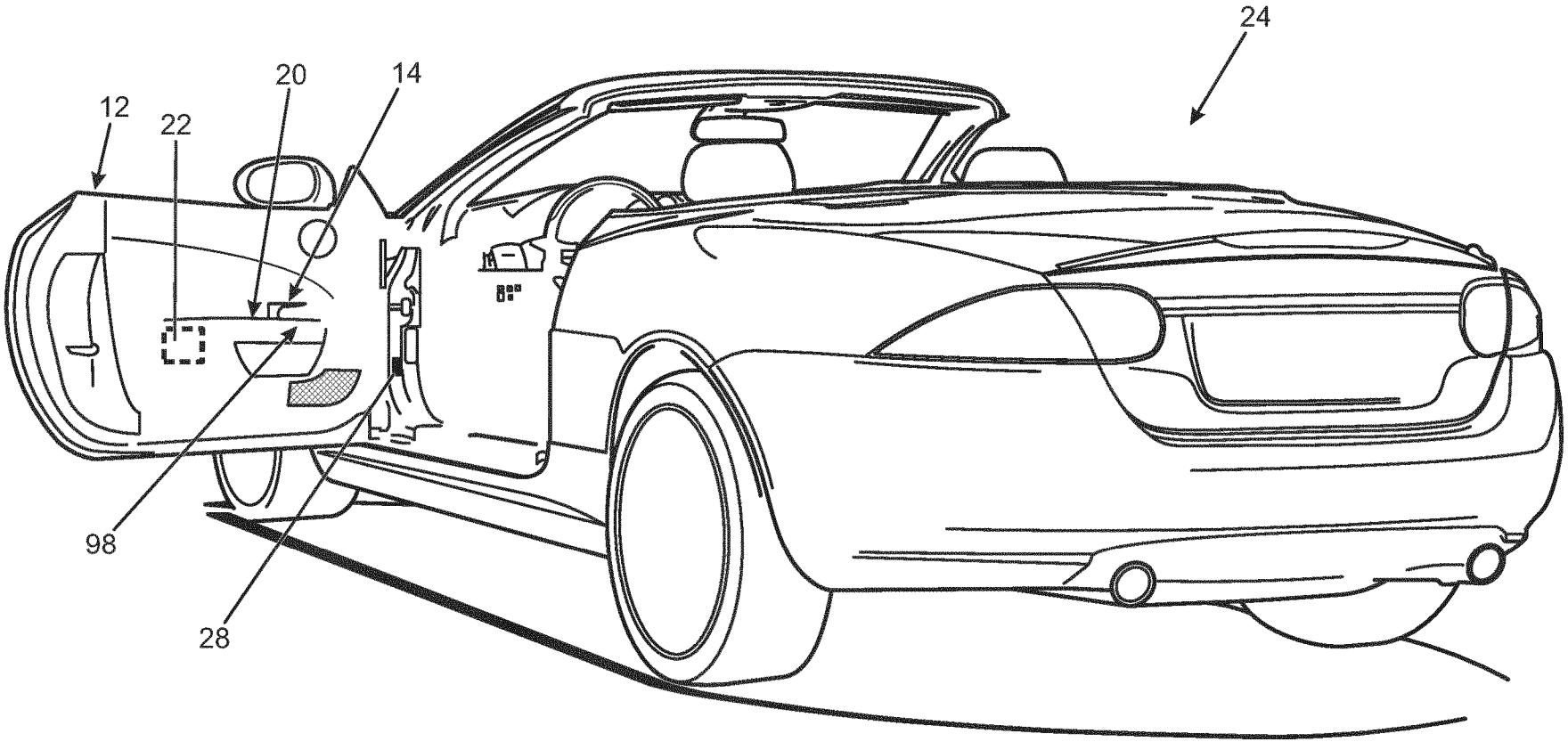
FIG. 11 is a diagrammatic rear perspective view of a car incorporating a vehicle door control arrangement according to an embodiment of the invention.

FIG. 1 shows the principal components of the arrangement 10 in diagrammatic form and shows a control unit 22, identified as a "Controller" in this drawing, which is shown diagrammatically in the door 12 of a car 24 in FIG. 11, but the control unit 22 could be located anywhere within the car as required.

Figure 7:
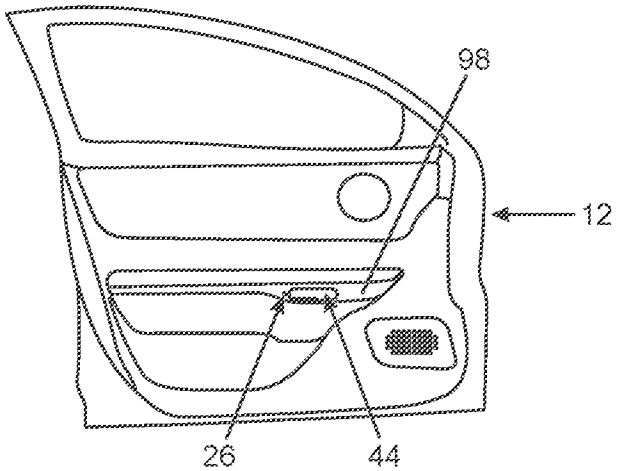
FIG. 7 is a diagrammatic interior view of a vehicle door incorporating the apparatus of FIG. 3 in a rest condition.
Figure 9:
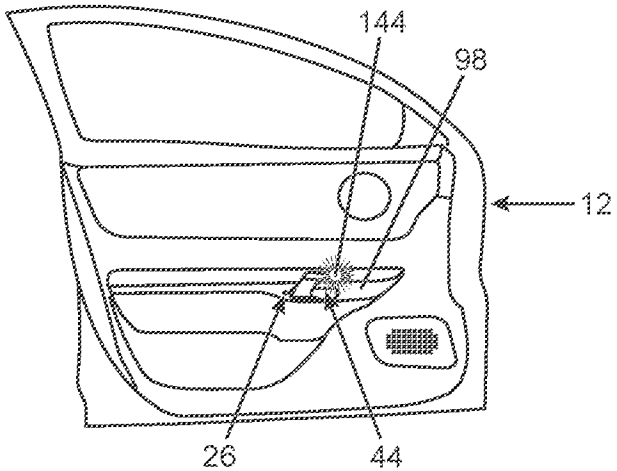
FIGS. 8 and 9 are respectively similar views to FIGS. 6 and 7 but with the apparatus in an operable position.

A proximity sensor 26 in the form of an infrared sensor is connected to the control unit 22, and can detect movement of a person's hand or other body part in close proximity thereto, to send a signal if the person wishes to open the door 12. Typically the proximity sensor can detect movement spaced around 0.5 to 5 cm, therefrom. The sensor 26 is also touch sensitive such that a person can also touch the sensor 26 to send a signal that they wish to open the door. As shown in FIGS. 7 and 9, the sensor 26 is located in the door trim panel 98, at a conventional location for a vehicle door handle.

A door ajar switch 28 is provided as is conventional to provide an indication that the door 12 is open. A start/stop switch 30 is also connected to the control unit 22. An output from the control unit 22 connects to a stepper driver 32 which is a micro stepping bipolar stepper motor driver for driving the door handle movement means 18 in the form of a linear actuator 34. The stepper driver 32 includes a current sensor 36 with an output to the control unit 22. The current sensor 36 checks for any fault conditions, and also for instance for any obstructions which may be detected. The linear actuator 34 includes position sensors 38 in the form of hall sensors mounted within the linear actuator 34.

A power supply 40 with a 12 volt DC input 41 is provided which provides a 12 volt output 42 to the linear actuator 34, and 5 volt outputs 43 to the control unit 22 and sensors 36, 38.

FIGS. 3-5 and 10 best show the mechanical components of the arrangement 10. The door handle means 14 is in the form of a cranked handle 44 with a relatively broad stem 46 and a narrower cross piece 48. An extension 50 extends from the stem 46 away from the cross piece 48 and has a pair of parallel arms 52 defining a space therebetween, with aligned holes 54 towards the end of the arms 52.

The control mechanism 16 includes a link member 56 with a generally V-shape profile. The link 56 has a longer arm 58 with a longitudinal slot 60 extending from its free end. The arm 58 slidably locates between the handle arms 52, with a first pin 62 extending between the holes 54 locating in the slot 60.

A pivotal mounting is provided at the apex of the V by a through hole 66. The other shorter arm 68 provides at its end a spaced pair of webs 70 with aligned through holes 72, which can locate a block 74 on the end of a cable 76 operably connected to a door latching means for the door 12. The shape of the link member 56 enables the arrangement 10 to locate in the door 12. It also enables a manual override if required of the arrangement 10 with less effort than otherwise would be the case.

The handle 44 is pivotally mounted adjacent the connection between the stem 46 and cross piece 48, by a second pin 79, to one end of a cranked bracket 78. The opposite end of the cranked bracket 78 mounts a plate 80 with a central hole 82 which mounts a distal end 84 of the linear actuator 34. The plate 80 also mounts a carriage 86 which is slidably moveable along an elongate guide rail 88 which is mountable on a bracket 90 mountable in the vehicle door 12.

Figure 10:
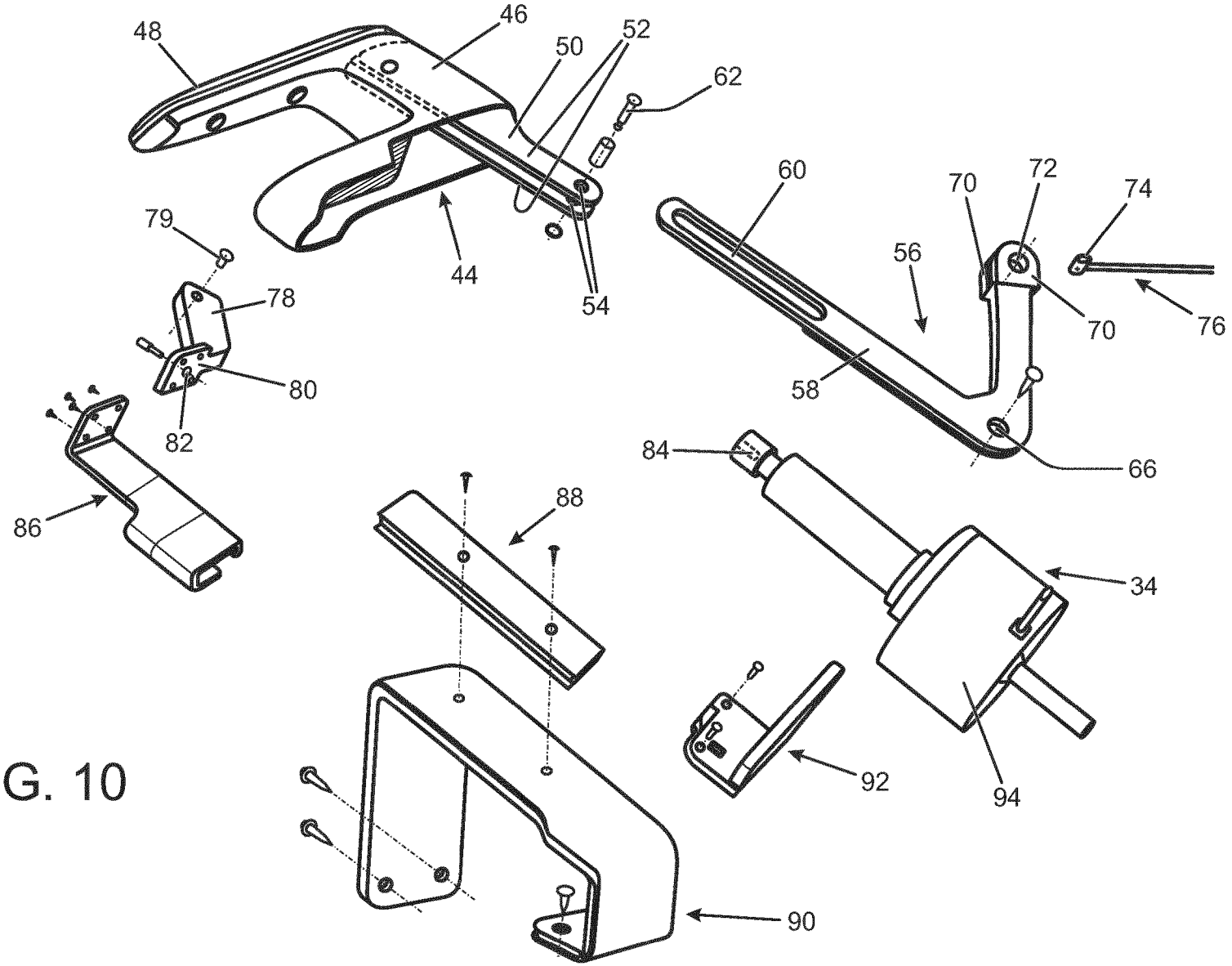
FIG. 10 is a diagrammatic perspective view of the components of the apparatus of FIG. 3.

The guide 88 is mountable extending along an upper face as shown in FIG. 10 of the bracket 90, and a mounting bracket 92 is provided at the lower end of the upper face as shown in FIG. 10. The bracket 92 mounts the proximal end 94 of the linear actuator 34. Accordingly the distal end 84 of the linear actuator 34 can be moved away from the proximal end 94, and is slidably guided by the carriage 86 moving along the guide 88. Operation of the linear actuator 34 and hence relative movement of the distal end 84, causes the handle 44 to slidably move relative to the link 56.

Figure 4:
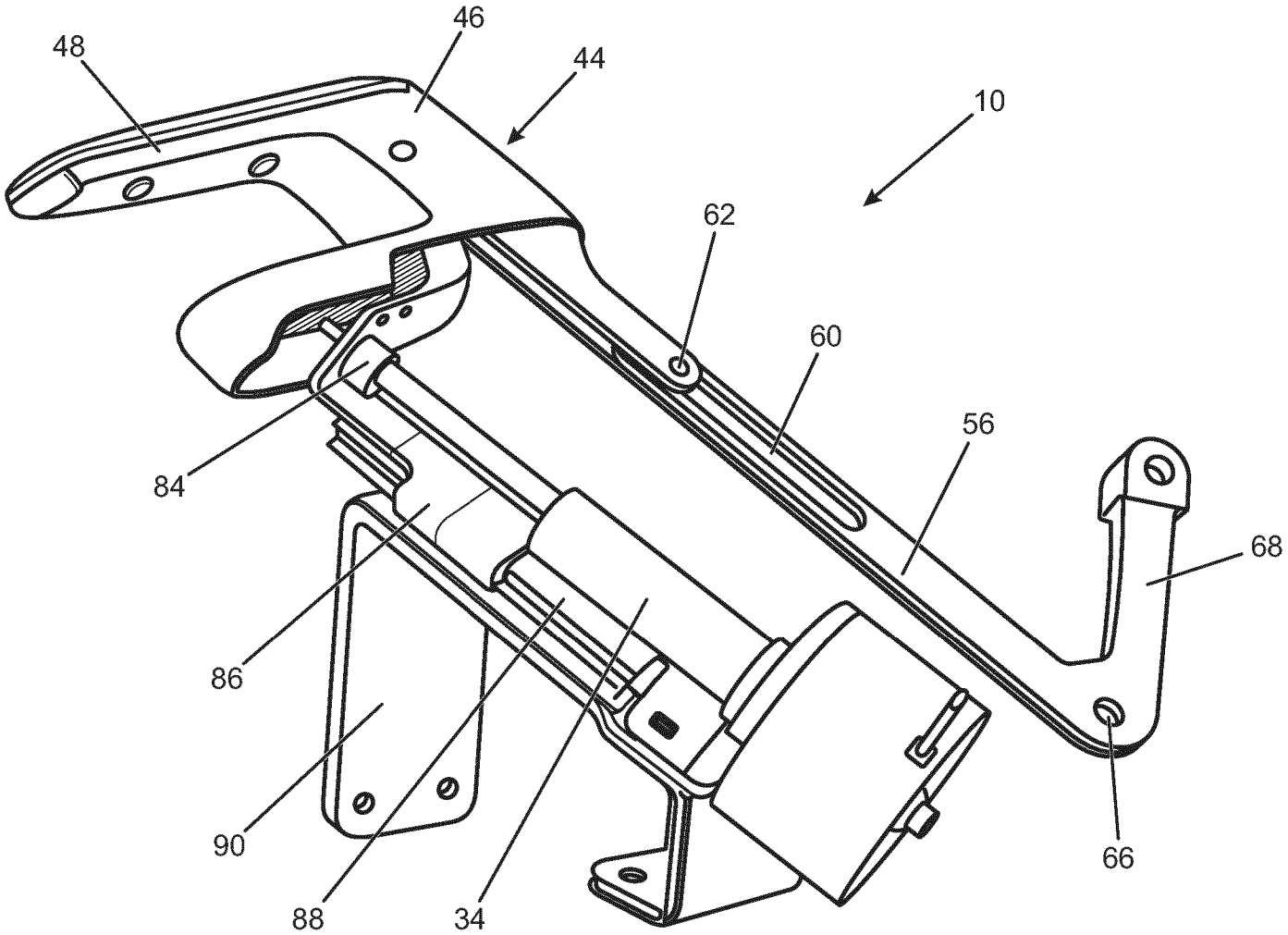
FIG. 4 is a similar view to FIG. 3 but in an operable condition.
Figure 6:
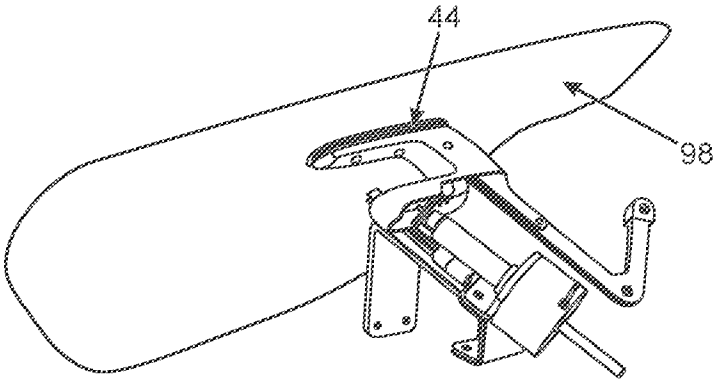
FIG. 6 is a diagrammatic perspective view of the arrangement of FIG. 3 installed in a vehicle door in a rest condition.
Figure 8:
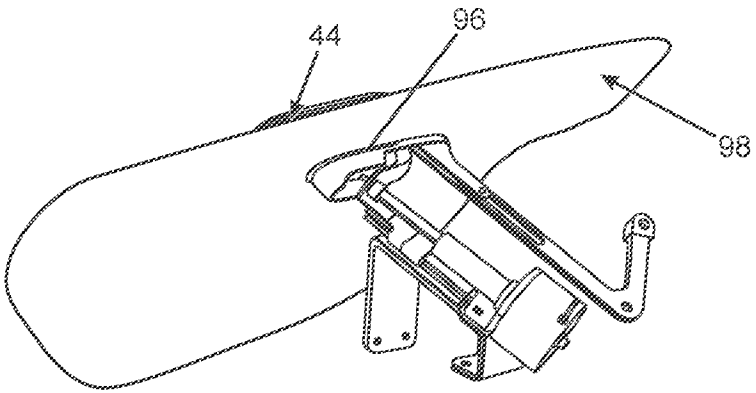

By extension of the linear actuator 34 as shown for instance in FIG. 4, the handle 44 is caused to move away from the link 56 and outwardly from the door 12 such that it can be engaged by a user. When the linear actuator 34 is fully retracted the handle 44 lies substantially flush with the inner face of the door 12. FIGS. 6 and 8 respectively show the handle 44 locating in, and extending from an opening 96 in a trim panel 98 of the door 12. The opening 96 is located adjacent the sensor 26.

Figure 2:
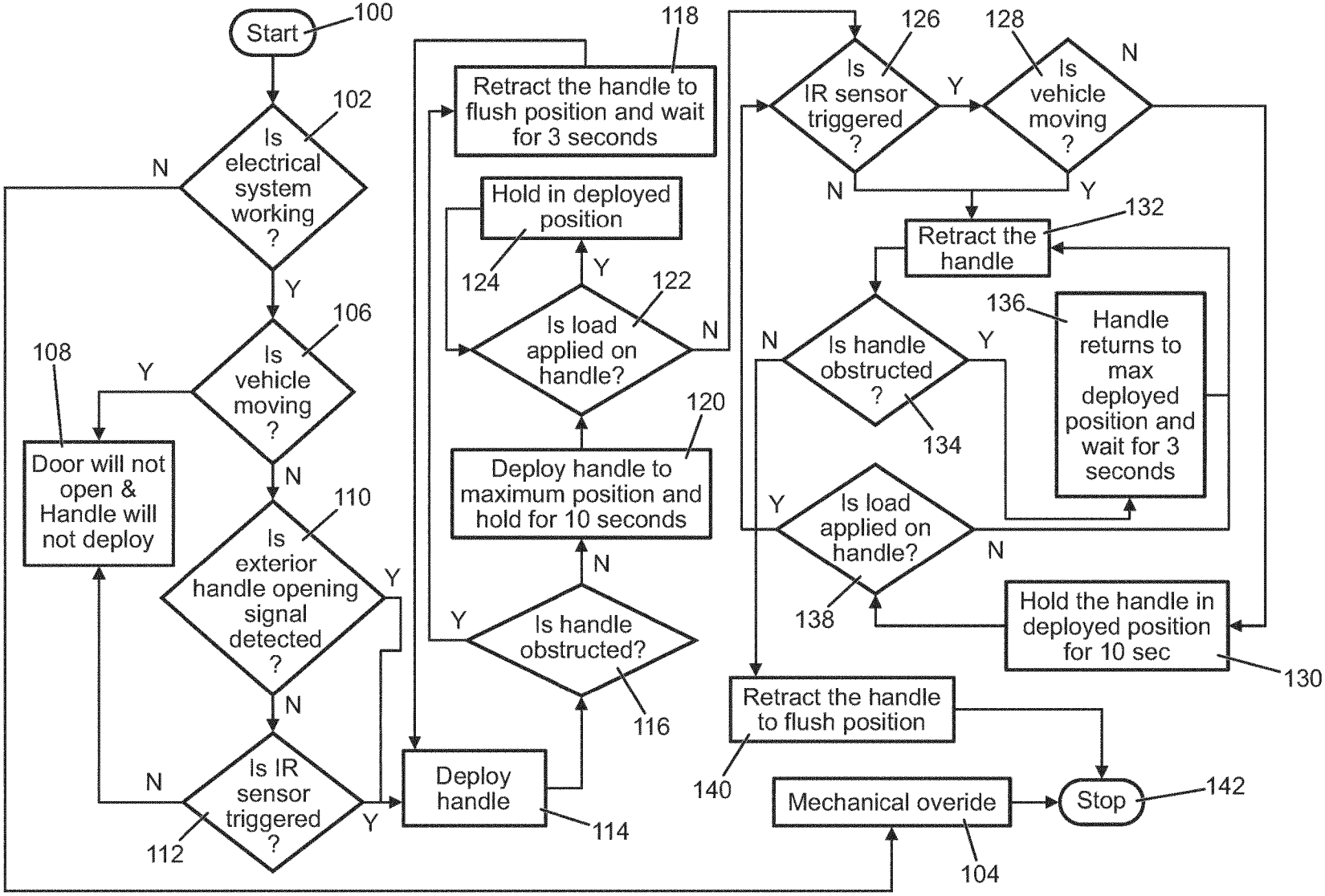
FIG. 2 is a flow chart illustrating operation of the arrangement of FIG. 1.

The vehicle door control arrangement 10 can operate as follows as described in relation to the flow chart shown in FIG. 2. At the start 100 a check 102 is made as to whether the electrical system is working. If not a mechanical override 104 is permitted. If the handle 44 is flush within the door 12, by pushing on the end of the stem 46 adjacent across the cross piece 48, the handle 44 can pivot outwardly relative to the cranked bracket 78 to provide a sufficient part of the cross piece 48 to be manually turned by a person for instance within the car 24, to enable opening of the door 12 even if the arrangement 10 is inoperable.

Figure 12:
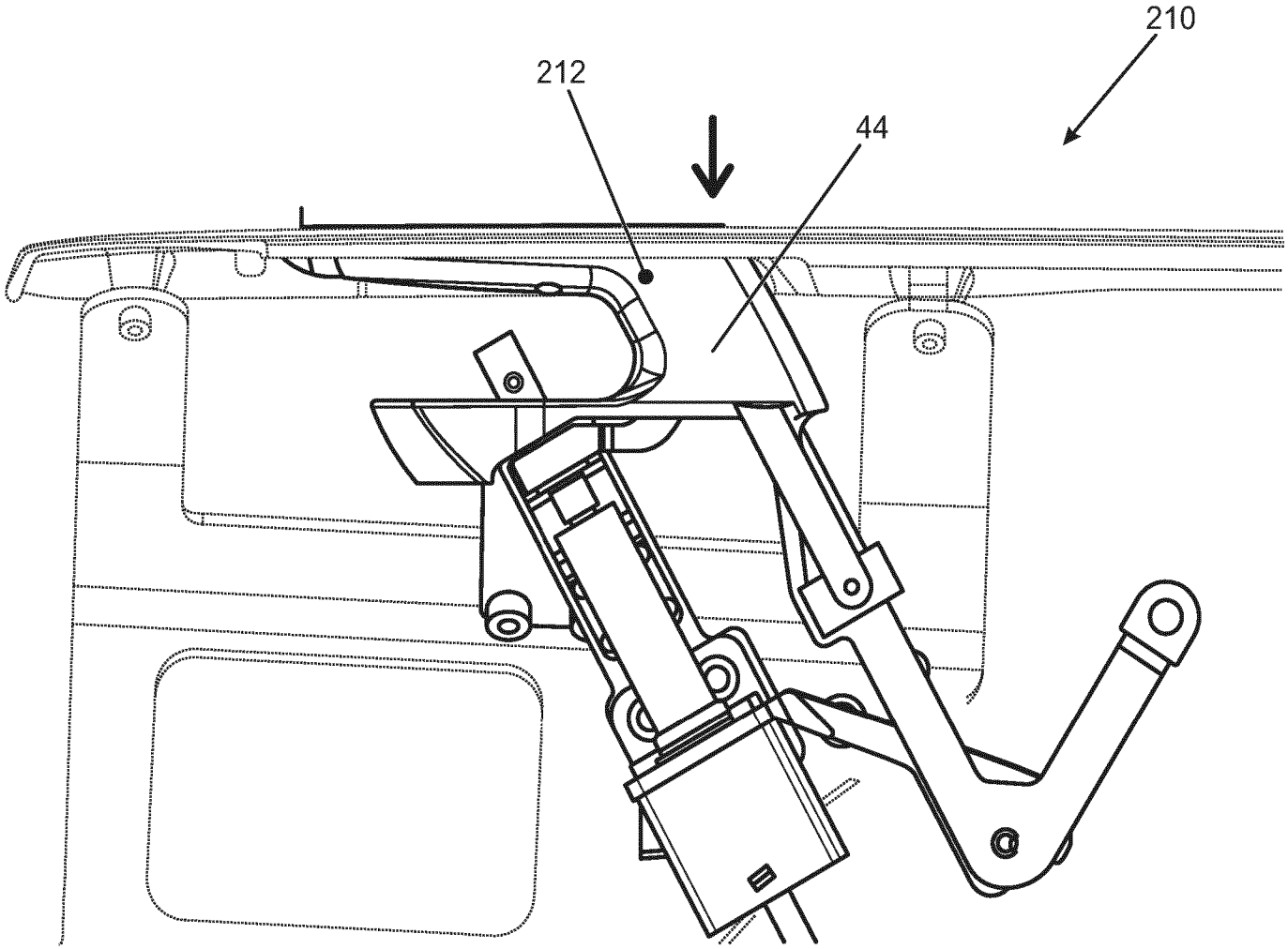
FIG. 12 is a diagrammatic view from above of a vehicle door arrangement according to a further embodiment of the invention.
Figure 13:
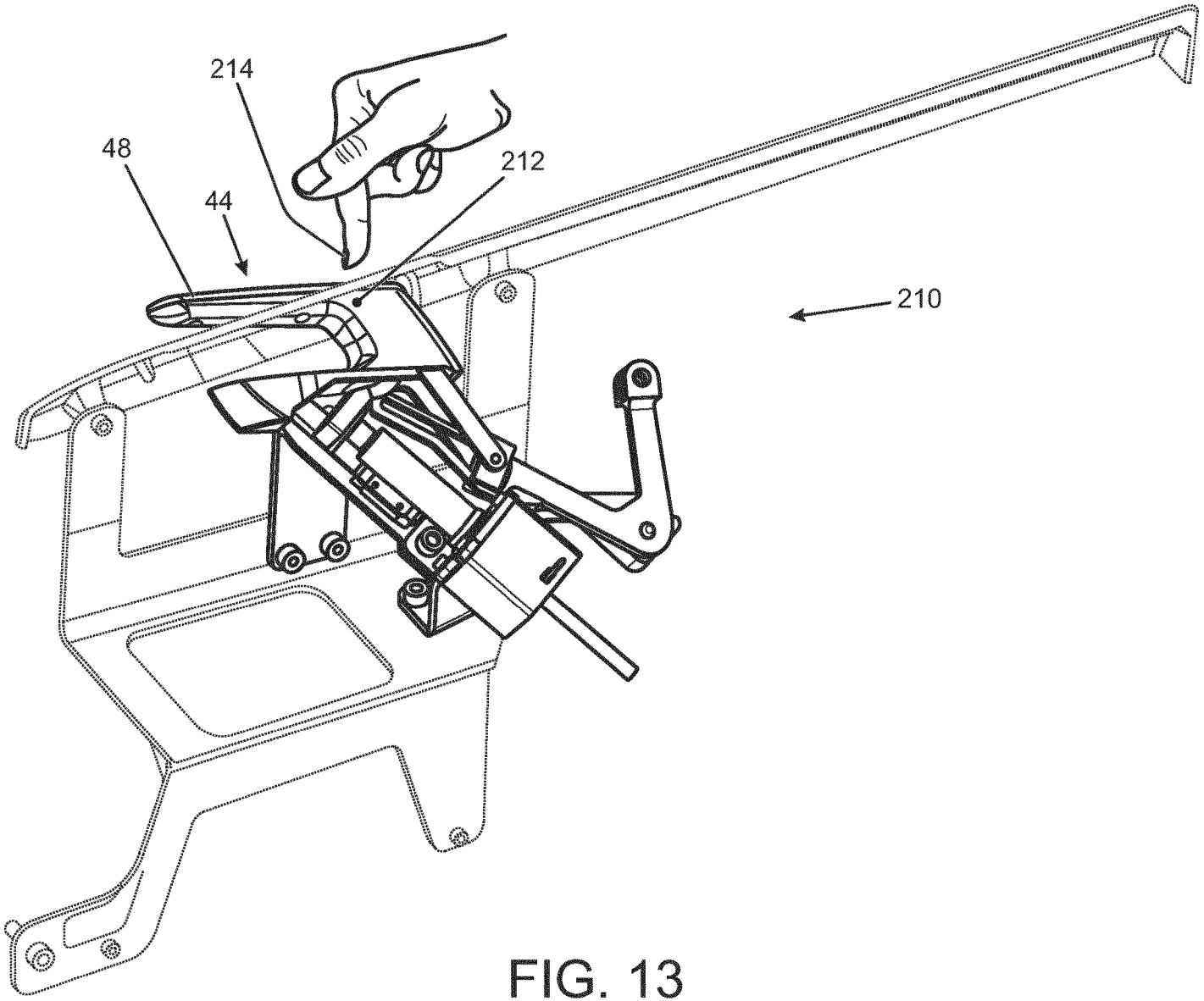
FIG. 13 is a diagrammatic perspective view of the arrangement of FIG. 12.

The mechanical override is best illustrated in FIGS. 12 and 13 and show a second, slightly different arrangement 210, but where similar components to the arrangement 10 have similar reference numerals. In the second arrangement 210 the pivotal mounting 212 is clearly shown, and if a force is applied as indicated by the arrow in FIG. 12, or the person's finger 214 in FIG. 13, the handle 44 can pivot outwardly such that the cross piece 48 can be accessed to manually open the door 12.

If it is detected that the electrical system is working, the control unit will run a check 106 as to whether the vehicle is moving. If so the door 108 will not be permitted to open by the latching arrangement, nor will the arrangement be operable to cause the handle 44 to move to an operable position.

If it is detected that the vehicle is not moving, a check 110 is made as to whether a signal is provided for the arrangement to move the handle 44 to an operable position, and whether the proximity sensor 26 is triggered at step 112. If yes the linear actuator 34 is operated at 114 to cause the handle 44 to move outwardly relative to the door 12. A check 116 is made by the current sensor 36 to see if the handle 44 is obstructed, as may be detected by an increased current flow in the linear actuator 34. If an obstruction is detected at 116 the linear actuator 34 will be reversed in movement 118 to retract the handle 44 back into the door 12.

If no obstruction is detected the handle 44 will move to an operative position 120 as shown for example in FIG. 4, and retained there at for a set length of time such as ten seconds.

Figure 5:
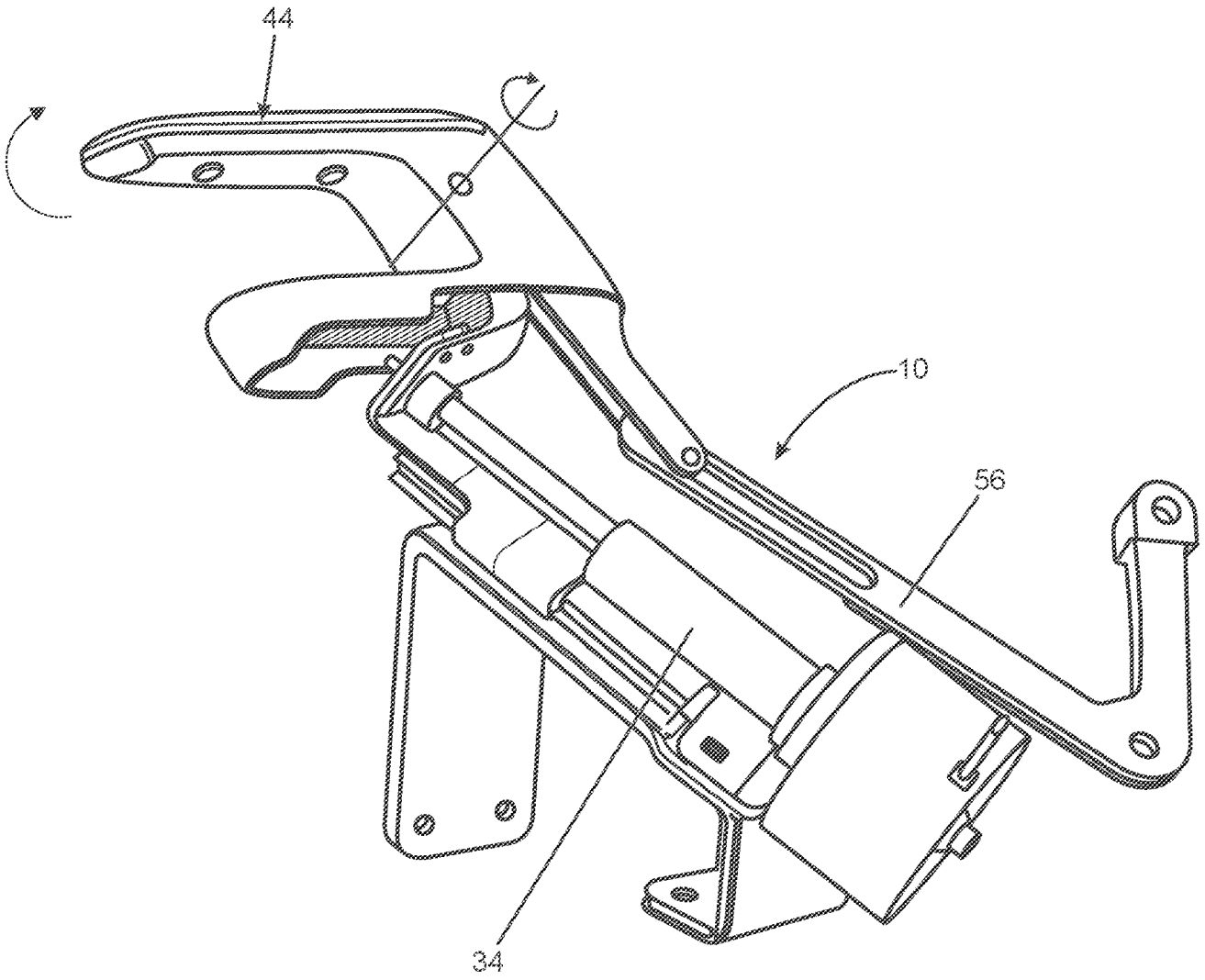
FIG. 5 is a similar view to FIG. 4 and with the arrangement in use.

The handle 44 can then be rotated as shown in FIG. 5. This causes the handle 44 to pivot about the distal end of the linear actuator 34. This causes the link 56 to be moved to the left as shown in FIG. 5 and by the arrow, which causes the cable 76 to be pulled and the door latching means to be operated.

A check 122 is then made as to whether a load is being applied to the handle 44 such as shown in FIG. 5 to open the door 12. If such a load is detected the handle 44 will be retained 124 in the operable position, and a further check 122 is subsequently made.

If it is detected that no load is being applied to the handle 44 a check 126 is then made as to whether the proximity sensor 26 is triggered. If so a further check 128 is made as to whether the car 24 is moving. If the car 24 is not moving the handle 44 will be retained 130 for a further ten seconds in the operable position. If though it is sensed that the vehicle is moving or the proximity sensor 26 is not triggered, the handle 44 will be moved back 132 into the door 12 by the linear actuator 34.

If as the handle 44 is being retracted it is detected that the handle 44 is obstructed 134, the handle 44 will return 136 to the fully operable position for a further three seconds and a further attempt will be made to retract the handle 44.

If no obstruction 134 is detected but a load is detected 138 being applied to the handle 44, again the handle 44 will return 136 to a fully operable position. If no obstruction or load is detected the handle 44 will be fully retracted 140 to a flush position and operation of the arrangement 10 stops 142.

It is to be realised that any of the set lengths of time may be selectively adjusted if required.

There is thus described a vehicle door control arrangement, a door including such an arrangement, a vehicle including one or more doors with such an arrangement which in normal use can provide a flush interior to the door, and also a method of controlling a vehicle door. The handle though can readily be caused to move to an operable position and enable conventional opening of the door.

As indicated safety checks are built into reverse movement of the handle if obstructions are checked, and to prevent use of the handle if the vehicle is moving. Also retraction of the handle is prevented if the handle is in use.

It may be required to provide an indication that the handle 44 is in or has moved to the operable position or that the proximity sensor 26 has recognized a signal from a user in the vehicle, and so the handle 44 is about to, or is moving to, the operable position. This tells the user they have made a successful gesture. A sound may be provided in the form of any conventional beep or other sound. Alternatively or in addition, a visual indication may be provided such as a light 144 (FIG. 9) can be provided which could for instance mean that the distal end of the handle 44 is lit, or any or all of the handle 44 could be lit.

In addition, and as previously mentioned, a signal may be emitted if it is detected that the handle cannot, or should not, be moved to either the operable or rest positions, for example up detection of an obstruction. Such a signal may be audible and or visual. For example, the light 144 may be caused to change colour when an obstruction is detected and/or a sound may be provided.

Although embodiments of the present invention have been described in the preceding paragraphs with reference to a particular example, it should be appreciated that modifications to the example given can be made without departing from the scope of the invention as claimed. For example a different arrangement could be used for moving the handle between the operable and rest positions. The handle may move in a different direction relative to the door. A different connection may be provided between the arrangement and the door latching arrangement.

The arrangement may include a proximity sensor, a touch sensitive sensor or a combined unit operable by proximity or touch.

For purposes of this disclosure, it is to be understood that the controller/control unit described herein can comprise a control unit or computational device having one or more electronic processors. A vehicle and/or a system thereof may comprise a single control unit or electronic controller or alternatively different functions of the controller may be embodied in, or hosted in, different control units or controllers.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A vehicle door control arrangement for permitting opening of a vehicle door, the vehicle door control arrangement comprising:

a door handle;

a door handle movement assembly operable to selectively move the door handle between a rest position in which the door handle is locatable substantially within a vehicle door, and an operable position in which the door handle extends outwardly from the vehicle door such that the door handle can be manually engaged by a person;

an operating unit to detect when it is required to open the vehicle door, and in response to cause the door handle movement assembly to move the door handle from the rest position to the operable position; and a control mechanism locatable in the vehicle door and operable by movement of the door handle to cause a door latch to disengage from a closed condition, wherein the door handle is configured such that it can operate the control mechanism even if not in the operable position, wherein the control mechanism includes a link connecting the door handle to the door latch and a cable extends from the link to the door latch, and further wherein a slidable connection is provided between the door handle and the link.

2. The vehicle door control arrangement according to claim 1, in which the operating unit is configured to detect movement of a person in the vicinity of the vehicle door control arrangement.

3. The vehicle door control arrangement according to claim 1, in which the operating unit is operable by touch at a particular location.

4. The vehicle door control arrangement according to claim 1, further comprising a control unit operably connected to the door handle movement assembly and the operating unit, wherein the control unit is configured such that after the handle has been in the operable position for a required time, the door handle movement assembly will automatically move the handle back to the rest position.

5. The vehicle door control arrangement according to claim 1, further comprising a control unit operably connected to the door handle movement assembly and the operating unit, wherein the control unit is configured to only permit operation of the door handle movement assembly to move the door handle to the operable position when it is detected that a vehicle is not moving.

6. The vehicle door control arrangement according to claim 1, further comprising a control unit operably connected to the door handle movement assembly and the operating unit, wherein the control unit is configured such that a signal is emitted if the handle moves to the operable position and/or if it is detected that the handle cannot, or should not, be moved to either the operable or rest positions.

7. The vehicle door control arrangement according to claim 6, in which the signal is audible or visual.

8. The vehicle door control arrangement according to claim 1, further comprising a control unit operably connected to the door handle movement assembly and the operating unit, wherein the control unit is configured to detect if the handle is obstructed when returning to the rest position, and if an obstruction is detected the handle returns to the operable position for a required time period.

9. The vehicle door control arrangement according to claim 1, further comprising a control unit operably connected to the door handle movement assembly and the operating unit, wherein the control unit is configured to detect if a load is being applied to the handle by a person, and to not move the handle to the rest position when a load is detected.

10. The vehicle door control arrangement according to claim 1, in which the handle is slidably moveable between the rest and operable positions.

11. The vehicle door control arrangement according to claim 10, wherein the door handle movement assembly further comprises a linear actuator for slidably moving the handle between the rest and operable positions.

12. The vehicle door control arrangement according to claim 11, in which a connection is provided between the handle and the linear actuator which enables a person to turn the handle relative to the linear actuator, and in which a pivotal mounting is provided for the handle on the connection to the linear actuator to permit the handle to be pivotally mounted.

13. The vehicle door control arrangement according to claim 1, in which the slidable connection moves relative to the link as the handle moves between the rest and operable positions.

14. The vehicle door control arrangement according to claim 1, in which the handle is linearly moveable between the rest and operable positions.

15. The vehicle door control arrangement according to claim 1, wherein the link of the control mechanism is a cranked link.

16. A vehicle door including:

a vehicle door control arrangement for permitting opening of the door, the vehicle door control arrangement comprising:

a door handle;

a door handle movement assembly operable to selectively move the door handle between a rest position in which the door handle is locatable substantially within the door, and an operable position in which the door handle extends outwardly from the door such that the door handle can be manually engaged by a person;

an operating unit to detect when it is required to open the door, and in response to cause the door handle movement assembly to move the door handle from the rest position to the operable position; and a control mechanism locatable in the door and operable by movement of the door handle to cause a door latch to disengage from a closed condition, and the door handle is configured such that it can operate the control mechanism even if not in the operable position, wherein the control mechanism includes a link connecting the door handle to the door latch and a cable extends from the link to the door latch, and further wherein a slidable connection is provided between the door handle and the link.

17. The vehicle door according to claim 16 in which the door handle is an interior door handle.

18. The vehicle door according to claim 16, wherein the link of the control mechanism is a cranked link.

19. A vehicle comprising:

a door; and a vehicle door control arrangement for permitting opening of the door, the vehicle door control arrangement comprising:

a door handle;

a door handle movement assembly operable to selectively move the door handle between a rest position in which the door handle is locatable substantially within the door, and an operable position in which the door handle extends outwardly from the door such that the door handle can be manually engaged by a person;

an operating unit to detect when it is required to open the door, and in response to cause the door handle movement assembly to move the door handle from the rest position to the operable position; and a control mechanism locatable in the door and operable by movement of the door handle to cause a door latch to disengage from a closed condition, and the door handle is configured such that it can operate the control mechanism even if not in the operable position, wherein the control mechanism includes a link connecting the door handle to the door latch and a cable extends from the link to the door latch, and further wherein a slidable connection is provided between the door handle and the link.

20. The vehicle accordingly to claim 19, wherein the link of the control mechanism is a cranked link.

* * * * *